US005360591A

United States Patent [19]

Ruetz et al.

[11] Patent Number: 5,360,591

[45] Date of Patent: Nov. 1, 1994

[54] REDUCED LEAD BISMUTH YELLOW BRASS

[75] Inventors: Roland L. Ruetz, Kohler; Jan V. Vojta; Donna L. Day, both of Sheboygan, all of Wis.

[73] Assignee: Kohler Co., Kohler, Wis.

[21] Appl. No.: 63,377

[22] Filed: May 17, 1993

[51] Int. Cl.[5] ..... C22C 9/04

[52] U.S. Cl. ..... 420/479; 420/478; 148/434

[58] Field of Search ..... 420/478, 479; 148/434; C22C 9/04

[56] References Cited

U.S. PATENT DOCUMENTS

| | | | |
|---|---|---|---|
| 1,149,850 | 8/1915 | Metzger | 420/483 |
| 1,921,417 | 8/1933 | Leach | 420/483 |
| 2,026,209 | 12/1935 | Brace | 420/497 |
| 2,073,371 | 3/1937 | Hensel | 420/497 |
| 2,188,681 | 1/1940 | Freeman et al. | 420/483 |
| 2,330,062 | 9/1943 | Lempert | 420/497 |
| 3,805,000 | 4/1974 | Roy | 200/144 |
| 4,091,248 | 5/1978 | Arakawa et al. | 200/144 B |
| 4,464,213 | 8/1984 | Nielsen | 148/442 |
| 4,678,720 | 7/1987 | Hsu et al. | 428/606 |
| 4,708,739 | 11/1987 | Kellie et al. | 75/76 |
| 4,733,018 | 3/1988 | Prabhu et al. | 174/68.5 |
| 4,879,094 | 11/1989 | Ruston | 42/476 |
| 5,000,779 | 3/1991 | German et al. | 75/244 |
| 5,137,685 | 8/1992 | McDevitt et al. | 420/471 |
| 5,147,469 | 9/1992 | Kanzaki et al. | 148/684 |
| 5,167,726 | 12/1992 | Lo Iacono et al. | 148/432 |
| 5,198,154 | 3/1993 | Yokoyama et al. | 252/514 |

FOREIGN PATENT DOCUMENTS

| | | | |
|---|---|---|---|
| 29020 | 9/1884 | Germany | 420/476 |
| 75003973 | 3/1976 | Japan . | |
| 54-135618 | 10/1979 | Japan . | |
| 57-73149 | 8/1982 | Japan . | |
| 57-73150 | 8/1982 | Japan . | |
| 59-50143 | 7/1984 | Japan . | |
| 61-133357 | 10/1986 | Japan . | |
| 4236735 | 8/1992 | Japan . | |
| 1157636 | 7/1969 | United Kingdom | 420/499 |
| 1157652 | 7/1969 | United Kingdom | 420/499 |
| 467126 | 10/1975 | U.S.S.R. . | |

OTHER PUBLICATIONS

Angino, Earnest et al., "Drinking Water Quality and Chronic Disease", *Environmental Science and Technology,* vol. 11, No. 7, pp. 660–665, Jul. 1977.

Subramanian, Kunnath S. et al., "Lead Contamination of Drinking Water," *Journal of Environmental Health,* vol. 54, No. 2, pp. 29–33, Sep./Oct. 1991.

J. Plewes et al., Advanced Materials & Processes 23–27 (Oct. 1991).

International Standard (ISO) 6509 (Jul. 1, 1981).

L. Northcott, Manuscript, 101–136 (Mar. 9, 1938).

L. Northcott, Manuscript, 173–204 (Jun. 28, 1939).

J. Dennison et al., 85 J. Inst. of Metals, 8–10 (Feb. 29, 1956).

J. Dennison et al., 81 J. Inst. of Metals, 513–520 (Dec. 12, 1952).

J. Wallace et al., "Grain Refinement Of Copper–Alloy Castings", 18–21 (undated admitted prior art).

A. Cibula, 82 J. Inst. of Metals, 513–524 (Jan. 21, 1954).

J. Audy et al., 117 CA Selects: Bismuth Chemistry Item 110873(d) 1 (1992).

J. Audy et al., 29 Prakt. Metallogr., 74–84 (1992).

*Primary Examiner*—Richard O. Dean
*Assistant Examiner*—Sean Vincent
*Attorney, Agent, or Firm*—Quarles & Brady

[57] ABSTRACT

Reduced lead bismuth yellow brasses are disclosed that are primarily useful for plumbing applications. Very low levels of grain refiners are used to increase dezincification resistance, to improve polishability, and for other desired characteristics. Silver and boron are preferred grain refiners.

6 Claims, No Drawings

REDUCED LEAD BISMUTH YELLOW BRASS

FIELD Of THE INVENTION

This invention relates to reduced lead brasses that are primarily useful in plumbing related applications. More particularly, it relates to the use of very low levels of certain grain refiners in these brasses.

BACKGROUND OF THE INVENTION

Elemental copper has been an important metal since ancient times. Recognized desirable attributes of copper include castability, workability, corrosion resistance, and more recently thermal and electrical conductivity. A primary shortcoming of elemental copper relates to machinability. Due to its somewhat gummy nature, copper will at the friction induced elevated temperatures that are encountered during machining clog cutting tools and increase power consumption.

In the past, lead has been added to copper (and copper alloys) to reduce the machinability problem and to provide other desired characteristics. However, recently there has been concern expressed by regulators regarding lead. Lead is already being phased out of the gasoline supply in response to this concern. Now there is a regulatory movement towards requiring reduction and/or removal of lead from brasses that are used to form plumbing conduits.

It is known that bismuth can improve the machinability of copper-containing alloys. See U.S. Pat. Nos. 5,167,726; 5,137,685; and 4,879,094. The disclosure of these patents are incorporated by reference as if fully set forth herein. The above patents teach that when using bismuth relatively high levels of certain elements such as phosphorus, indium, and tin must also be present to offset certain adverse effects of bismuth.

In much of the world, "yellow brass" is relied upon to meet the demands and properties required of cast plumbing products. Yellow brasses typically have 55–70% Cu and 30–45% Zn. Aluminum is often present at below 1.5% and iron is also sometimes present at below 0.5%. Nickel is sometimes present. Trace amounts of S, Mg, Mn, P, As, Se, Te, Sb, Si, Sn, and other elements are also sometimes present in yellow brass (e.g. in certain cases when recycled metal starting materials are used). Plumbing applications require yellow brass alloys that are corrosion resistant, and have good polishability, machinability, strength, and pressure tightness. The brass must also exhibit good castability (freedom from cracks in casting, handling and trimming).

Unfortunately, the art has not yet been able to develop a lead free bismuth yellow brass that is suitable for those plumbing applications where the brass is regularly exposed to water. This is in part due to the tendency of bismuth yellow brasses to dezincify (lose their zinc to the water), with resulting corrosion problems. Thus, a need exists for an improved reduced lead bismuth yellow brass that is useful for plumbing applications.

SUMMARY OF THE INVENTION

It has been discovered that the use of certain grain refiners at very low levels will lead to optimum characteristics on a micro and macro level in reduced lead bismuth yellow brass alloys. In this regard, the surface tension of the host metal is a major contributor to the shape and distribution of the bismuth phase. A progression in shape and distribution occurs with varying grain refiner concentration from the undesirable forms to the more desirable, and then back to the undesirable. As grain refining additions increase beyond the optimum range, bismuth inclusions continue to be rounded by virtue of the magnitude of the reduction of surface tension in the host metal. However, with addition of more grain refiner the bismuth distribution begins to deteriorate, with adverse effects.

In one aspect, the invention provides a brass alloy comprising 55% to 70% Cu; 30% to 45% Zn; 0.2% to 1.5% Bi; 0.2% to 1.5% Al; 0 to 1% Pb, and at least two grain refiners selected from the group consisting of B, In, Ag, Ti, Co, Zr, Nb, Ta, Mo, Tl, and V. At least one of the two grain refiners is selected from the group consisting of B, Ti, Co, Zr, Nb, Ta, Mo, Tl, and V and is between 0.0001% and 0.003% of the alloy. When Ag or In is one of the two grain refiners, it is less than 0.25% of the alloy.

Preferably, the alloy also has 0.1% to 2.0% Ni, 0.05% to 0.5% Fe, 0.75% to 1.1% Bi, 0.2% to 0.9% Al, and between 0.003% and 0.05% Ag. In an especially preferred form, Ag and B are grain refiners in the alloy.

In another aspect, the invention provides a brass alloy that has 55%–70% Cu; 30%–45% Zn; 0.2%–1.5% Bi; 0.2%–1.5% Al; 0%–1% Pb; 0%–2% Ni; 0.05%–0.5% Fe; and at least two grain refiners selected from the group consisting of B, In, Ag, Ti, Co, Zr, Nb, Ta, Mo, Tl, and V, wherein at least one of the two grain refiners is selected from the group consisting of B, Ti, Co, Zr, Nb, Ta, Mo, Tl, and V and is between 0.0001% and 0.01% of the alloy. If Ag or In is selected as one of the two grain refiners, it is less than 0.25%.

In yet another aspect, the invention provides a brass alloy comprising 55%–70% Cu; 30%–45% Zn; 0.2%–3.0% Bi; 0.2%–1.5% Al; 0%–1% Pb; less than 2% Ni; 0.05%–1% Fe; and 0.005%–0.3% Ag (or in the alternative 0.005%–0.3% In). If desired, one or more other grain refiners may also be present in this alloy.

When it is desired to have both good polishability and superior dezincification resistance, grain refiners other than Ag and In should total at least 0.0001% (preferably 0.001%–0.003%) and not exceed in total 0.004%. Preferably Ag (or Indium) is between 0.005%–0.03% (0.13% is highly preferred).

If good polishing is desired, but superior dezincification resistance is not mandatory (e.g. brass used for a decorative escutcheon on a bathroom towel bar), less grain refiners can be used.

It will be appreciated that it has been discovered that very low levels of certain grain refiners can provide superior dezincification characteristics to reduced lead bismuth yellow brasses without adversely affecting other required characteristics. It has also been discovered that silver is a highly desirable grain refiner for bismuth yellow brass, especially in combination with boron. It has also been discovered that if grain refiner levels are outside the specified ranges, they will severely impede certain characteristics that are critical to plumbing utility.

The objects of the present invention therefore include providing a bismuth yellow brass of the above kind that:

(a) has reduced lead levels (or no leads;
(b) has improved dezincification resistance;
(c) is resistant to cracking and corrosion;
(d) is readily polishable and workable; and
(e) uses grain refiners that are readily available.

Another object is to provide such a brass that has improved microstructure and crystal form so as to permit superior castability. These and still other objects and advantages of the present invention will be apparent from the description below.

DESCRIPTION OF THE PREFERRED EMBODIMENTS

The following examples utilized bismuth yellow brass alloys containing about 1% bismuth, about 61.5% copper, about 36% Zn, about 0.7% Al, about 0.08% Fe, about 0.6% Ni, no Pb, and varying levels of the specified grain refiners. Individual tests included in each example contained a particular level of grain refiners. Each test was examined for microstructure where sections were examined for the randomization of bismuth in the alloy. A desired microstructure is where the bismuth is randomized and not clustered in the alloy.

Each example was also analyzed for dezincification resistance. This was determined following the procedure set forth in the International Organization For Standardization, Publication 6509 (1981). Maximum dezincification below 400 microns (and preferably below 300 microns) are desired for plumbing conduits. In each of the examples, the grain refiner is added to 45,400 grams of the base metal. One first creates a melt of the base metal at 1650° F., and then increases the heat to 1830° F. At 1830° F., one then adds the grain refiners. One then heats to 1900° F. and thereafter lets the melt cool to the pouring temperature of 1860° F. The metal can be poured into the usual brass molds for plumbing products.

EXAMPLE 1

0.6 g B and 7.5 g Ag.

Example 2

0.6 g B; 6 g Ag; 0.15 g Zr.

Example 3

0.5 g B; 6 g Ag; 0.5 g V.

Example 4

0.5 g B; 6 g Ag; 0.5 g Nb.

Example 5

0.5 g B; 6 g Ag; 0.65 g Ta.

Example 6

0.5 g B; 6 g Ag; 0.15 g Ti.

The above examples all provide good dezincification resistance of below 325 microns maximum and often about 250 microns average (using the 6509 test), and good polishing characteristics. Silver/boron combinations are especially preferred, but indium can be substituted for Ag if desired. Boron is readily available as 2% copper boron (and in other forms). Silver is readily available in ingots of 999 fine silver.

There are also certain plumbing applications (e.g. ornamental trim) where high dezincification resistance is not as critical. For these, we developed lower cost alloys that had good polishing characteristics while using less refiner.

Examples 7–13

0.6g B with 0.0066% Ag alone, or with 0.0017% Zr, or with 0.0025% of any one of V, Nb, Ta, Ti or Co. These examples exhibited dezincification levels of 400–700 microns maximum, but still had good polishing characteristics.

There are still other applications where neither dezincification resistance, nor polishing characteristics are important. For these we developed the following metals in which high levels of grain refiners can be used.

Example 14

0.6 g–8.0 g B

Example 15

6 g–114 g Ag; 6 g B

Grain refiners can be delivered directly (e.g. in elemental form), or as part of compounds such as TlBr; $MoCl_5$; $MO_3Al$; MoB; $AgBF_4$; $CAB_6$; etc.

Where pure inputs are available, the specified levels of grain refiners can readily be achieved. If recycled metals are used as inputs, careful monitoring of metal content is advisable, preferably by chemical analysis prior to casting or by thermal analysis of a test sample during cooling and solidification. If the input metal already has traces of the grain refiners in it as impurities, desirable ranges might be exceeded by adding the usual amount.

The above alloys can be used to cast plumbing products, bathroom accessories, and other items, following the same techniques that are currently used with yellow brass.

Although the present invention has been described with reference to certain preferred embodiments, other variants are possible. For example, it is not critical that either Ag or B be used, albeit the use of both is preferred. Also, grain refiners that change fineness and beta orientation such as indium, silver, and boron can be combined with those that affect columnar grain growth (e.g. Ti, Zr, Co) to achieve varied properties. .Therefore, the scope of the claims is not limited to the specific examples of the preferred versions herein. Rather, the claims should be looked to in order to judge the full scope of the invention.

We claim:

1. A brass alloy, comprising:

55% to 70% Cu;
30% to 45% Zn;
0.2% to 1.5% Bi;
0.2% to 1.5% Al;
0% to 1% Pb; and at least two grain refiners selected from the group consisting of B, In, Ag, Ti, Zr, Nb, Ta, Mo, Tl, and V, wherein at least one of the grain refiners is selected from the group consisting of B, Ti, Zr, Nb, Ta, Mo, Tl and V and is between 0.0001% and 0.003% of the alloy, wherein if Ag or In is selected as a grain refiner it is less than 0.25% of the alloy.

2. The alloy of claim 1, wherein the alloy has Ag and B.

3. The alloy of claim 1, wherein the alloy has 0.1% to 2.0% Ni, 0.05%–0.5% Fe, 0.75%–1.1% Bi, 0.2% - 0.9% Al, and less than 0.05% Ag.

4. A brass alloy casting, comprising:

55% to 70% Cu;
30% to 45% Zn;
0.2% to 3.0% Bi;
0.2% to 1.5% Al;
0% to 1% Pb;
0% to 2% Ni;
0.05% to 0.5% Fe; and at least two grain refiners selected from the group consisting of B, In, Ag, Ti, Zr, Nb, Ta, Mo, Tl, and V, wherein at least one of the grain refiners is selected from the group consisting of B, Ti, Zr, Nb, Ta, Mo, Tl and V and is between 0.0001% and 0.01% of the alloy, wherein if Ag or In is selected as a grain refiner it is less than 0.25% of the alloy.

5. A brass alloy, comprising:
55%–70% Cu;
30%–45% Zn;
0.2%–3.0% Bi;
0.2%–1.5% Al;
0%–1% Pb;
less than 2% Ni;
0.05%–1% Fe; and
0.005%–0.3% Ag.

6. A brass alloy, comprising:
55%–70% Cu;
30%–45% Zn;
0.2%–3.0% Bi;
0.2%–1.5% Al;
0%–1% Pb;
less than 2% Ni;
0.05%–1% Fe; and
0.005%–0.03% In.

* * * * *

UNITED STATES PATENT AND TRADEMARK OFFICE

CERTIFICATE OF CORRECTION

PATENT NO. : 5,360,591
DATED : November 1, 1994
INVENTOR(S) : Roland L. Ruetz, et al It is certified that error appears in the above-indentified patent and that said Letters Patent is hereby corrected as shown below:

Column 2, line 64, "(or no leads" should read --(or no lead)--.

Column 4, line 15, "$MO_3Al$" should read --$Mo_3Al$-- and "$CAB_6$" should read --$CaB_6$--.

Claim 4, line 1, "casting" should be deleted and line 4, "3.0%" should read --1.5%--.

Signed and Sealed this

Thirty-first Day of January, 1995

*Attest:*

*Attesting Officer*

BRUCE LEHMAN

*Commissioner of Patents and Trademarks*